US012766394B2

(12) United States Patent
Lay et al.

(10) Patent No.: US 12,766,394 B2
(45) Date of Patent: Oct. 20, 2026

(54) SHOCK-ABSORBING BALL-HITTING TRAINER

(71) Applicant: World Sports Products, Inc., St. George, UT (US)

(72) Inventors: William Coleman Lay, St. George, UT (US); Joseph Coleman Lay, St. George, UT (US)

(73) Assignee: World Sports Products, Inc., St. George, UT (US)

( * ) Notice: Subject to any disclaimer, the term of this patent is extended or adjusted under 35 U.S.C. 154(b) by 198 days.

(21) Appl. No.: 18/902,789

(22) Filed: Sep. 30, 2024

(65) Prior Publication Data

US 2026/0091287 A1 Apr. 2, 2026

(51) Int. Cl.

*A63B 69/00* (2006.01)
*A63B 71/00* (2006.01)
*A63B 71/02* (2006.01)

(52) U.S. Cl.

CPC ..... *A63B 69/0084* (2013.01); *A63B 71/021* (2013.01); *A63B 71/023* (2013.01); *A63B 2071/0063* (2013.01); *A63B 2225/093* (2013.01)

(58) Field of Classification Search

CPC ..... A63B 69/0008; A63B 69/0079; A63B 69/0084; A63B 69/38; A63B 71/021; A63B 71/023

See application file for complete search history.

(56) References Cited

U.S. PATENT DOCUMENTS

| | | | | | |
|---|---|---|---|---|---|
| 1,224,410 | A | | 5/1917 | Porte | |
| 1,907,412 | A | | 5/1933 | Zimmer | |
| 2,680,022 | A | | 6/1954 | Walden | |
| 2,942,883 | A | * | 6/1960 | Moore | A63B 43/007 473/424 |
| 3,086,775 | A | | 4/1963 | Albert | |
| 3,558,134 | A | * | 1/1971 | Hoitsma | A63B 69/0075 473/428 |
| 3,630,521 | A | * | 12/1971 | Lingbeek | A63B 69/0084 473/428 |
| 3,652,088 | A | | 3/1972 | Marsh | |
| 3,754,761 | A | | 8/1973 | Pruss | |
| 3,924,855 | A | * | 12/1975 | Pretorius | A63B 69/0084 473/430 |
| 4,127,268 | A | * | 11/1978 | Lindgren | A63B 43/007 473/576 |

(Continued)

*Primary Examiner* — Christopher R Legendre
(74) *Attorney, Agent, or Firm* — Madson IP, P.C.

(57) ABSTRACT

A multi-functional, shock-absorbing ball-hitting trainer is used to develop hitting and/or striking skills and to establish muscle-memory for a user. The ball-hitting trainer has a first stanchion, a second stanchion, a rope line extending between the first stanchion and the second stanchion to form an inclined line, and the rope line spanning a distance from a first connection to the first stanchion to a second connection to the second stanchion forming an inclined line, and a ball tether assembly having a ball, a suspension ring encircling the inclined line, and a tether secured between the ball and the suspension ring so that the ball tether assembly may slidably travel along the inclined line. The ball-hitting trainer may also have in-line shock-absorbing impact-recoil feature, a height-adjustable in-line stop feature, and an in-line tensioner for tightening and loosening the rope line.

17 Claims, 7 Drawing Sheets

(56) References Cited

U.S. PATENT DOCUMENTS

| | | | | |
|---|---|---|---|---|
| 4,944,513 | A * | 7/1990 | Zentner | A63B 69/0084 473/428 |
| 5,611,539 | A | 3/1997 | Watterson et al. | |
| 6,884,187 | B2 * | 4/2005 | Cataldi, Jr. | A63B 69/0086 473/424 |
| 9,314,681 | B2 * | 4/2016 | Palardis | A63B 69/0002 |
| 9,486,682 | B2 * | 11/2016 | Daugard | A63B 69/0002 |
| 10,456,648 | B1 | 10/2019 | Imahata | |
| 10,994,181 | B1 * | 5/2021 | Palardis | A63B 69/0002 |
| 2017/0128810 | A1 * | 5/2017 | Drouillard | A63B 69/0002 |
| 2026/0091287 | A1 * | 4/2026 | Lay | A63B 69/0084 |

* cited by examiner

SHOCK-ABSORBING BALL-HITTING TRAINER

BACKGROUND OF THE INVENTION

1. Field of the Invention

The present invention relates to single-user sports training devices, and more particularly, to a multi-functional, shock-absorbing ball-hitting trainer that enables a user to practice and develop hitting/striking skills while practicing alone. Additionally, the present disclosure relates to the field of recreational equipment, and more specifically, to sports training equipment that assists in developing muscle memory for desired skills.

2. The Relevant Technology

In many sporting events players participate by pitching, hitting, catching, and/or fielding balls. During training, such players may practice within specialized enclosures such as batting cages, bullpen enclosures, and the like that are enclosed by netting or in less confined space such as on a practice field, court, or in a ballpark. For some sports, practicing certain skills is not readily conducive to practicing alone, at your own pace or for as long as you wish. Whether the practicing activity is done individually, in a small group, or as a team, the balls used may come to rest randomly scattered within the enclosure or about the court, practice field, or ballpark. For example, batting practice for baseball or softball requires someone else to pitch or operate a pitching machine, or to shag balls hit into the field or missed. It is unrealistic to try to pitch to yourself and it is time and energy consuming to retrieve balls either hit or missed.

Over the years, there have been various developments in sports training devices to facilitate the development of hitting and striking skills while practicing alone. For example, balls tethered to a pole much like a tetherball and pole have been used to practice various hitting or striking strokes for sports such as baseball, softball, tennis, and the like. This type of practice device eliminates shagging balls, but the ball travels around the pole so erratically, it is difficult to get enough controlled repetition to develop positive muscle memory skills and bad habits may be rewarded rather than proper skill sets.

Hitting a ball suspended from a line also has been developed with less than optimum results. Some use a ball tethered to a rope pulley or rope trolley mechanism that constrains the reaction and trajectory of the ball as it leaves the bat, racket, foot or hand, because there is a weight drag designed into the mechanism. Others use a rigid or semi-rigid tether (such as a metallic rod, wire cable, or a metal chain) that again inhibits the ball trajectory from a its natural reaction and trajectory and also may give a very unnatural recoil sting to the user if such tethers are struck instead of hitting/striking the ball flush. Further, as the ball returns back down the line toward the user, the momentum of the mechanism and/or the rigid/semi-rigid tether may impart counterproductive momentum that may slow natural attenuation of ball motion causing erratic return of the ball to the user's hitting/striking area.

Moreover, training devices utilizing a ball suspended from a line that are not readily portable (easy to assemble, disassemble, and transport) present additional concerns. Some such training devices have the line secured to a tree, a wall, a permanent pole (like a light pole, telephone pole, a fence post) and the like, frequently requiring a ladder to secure, unsecure, and/or height-adjust the line.

Accordingly, a need exists for a readily portable, multi-functional ball-hitting trainer that facilitates single user training and/or training for users of all ages, shapes, sizes, and abilities, accommodates switch hitters/strikers, and better emulates natural ball movement and trajectory caused by hitting/striking impact and shock-absorbing recoil. Specifically, that need is addressed by a new multi-functional ball-hitting trainer is disclosed herein.

Further, a need exists for a ball-hitting trainer that is capable of accommodating various types of balls (such as baseballs, softballs, tennis balls, cricket balls, soccer balls, footballs, etc.).

BRIEF SUMMARY OF THE INVENTION

The present invention has been developed in response to the present state of the art, and in response to the problems and needs in the art that have not yet been fully solved and is not currently available. The present invention provides a new readily portable, multi-functional ball-hitting trainer for teaching hitting/striking skills and establishing muscle-memory for a user.

The ball-hitting trainer of the present invention has stanchions mountable on a support surface to be disposed upright. The stanchions comprise a first stanchion and a second stanchion, each stanchion having an apex and a base. Although the first stanchion and the second stanchion may be of equal or substantially equal height, the stanchions may have different heights. For example, the second stanchion may be of a greater length than the length of the first stanchion so that when placed upright, the second stanchion is of greater height than the first stanchion. Within this disclosure, when the upright second stanchion has greater height than the upright first stanchion, the second stanchion sometimes may be referred to as the tall-height stanchion and the first stanchion sometimes may be referred to as the short-height stanchion. The base of each stanchion being supportable upon the support surface so that the apex of each stanchion is spaced above the support surface. The base of the first stanchion may be positioned a run distance from the position of the second stanchion.

With the stanchions spaced a run distance apart, a rope line is connectable between the first stanchion and the second stanchion. The rope line spans a distance from a first connection to the first stanchion to a second connection to the second stanchion. When the second connection is disposed at a greater height from the support surface than the height of the first connection the rope line forms an inclined line having an upper portion (proximate the second stanchion) and a lower portion (proximate the first stanchion) that inclines from the first stanchion to the second stanchion. The inclined line defines a launch angle at which the ball reacts when hit/struck, and the launch angle is adjustable to better emulate line drives or fly balls for users of all ages, shapes, sizes, and abilities. Such adjustability may be accomplished by varying the spaced run distance and/or by adjusting the relative heights of the connections to the stanchions and/or adjusting the swing height (discussed in more detail below).

Further, a ball tether assembly slidably engages the rope line, thereby enabling the ball tether assembly to travel along the rope line in a travel path when hit or struck by the user and to return to the user by sliding back down the incline of the rope line (i.e., the inclined line). The ball tether assembly comprises a ball, a suspension ring, and a tether secured between the ball and the suspension ring. The suspension ring encircles the rope line such that minimal friction is encountered by the ball tether assembly when traveling either up or down the inclined line. The suspension ring may be made of any suitable shape and material such as a metal O-ring, a plastic O-ring, a split key ring, a spring snap hook, an oval screw link, a carabiner, an oval carabiner, a twist lock carabiner, and the like. The ball may also be of any suitable type that is typically hit by a bat, a racquet, or any other sports implement and/or struck by a user's foot or hand, such as a baseball, a softball, a tennis ball, a golf ball, a soccer ball, a football, a cricket ball, a foam ball, a pickleball, a wiffle ball, a handball, a racquetball ball, a field hockey ball, a street hockey ball, a lacrosse ball, a volleyball, a kickball ball, a squash ball, and the like. The tether also may be of any suitable type such as a rope, a flexible cable, a webbing strap, a leather strap, an clastic strap of cord, and the like.

In one exemplary embodiment, the tether may be a single-strap tether secured between the ball and the suspension ring, comprising a strap having opposing ends, a length, a breadth, and a thickness. The ball may have two through bores lying in a first plane that substantially halves the ball. Each of the two through bores, one an entry through bore and the other an exit bore, may be positioned substantially equidistant from a second plane (substantially perpendicular to the first plane) that perpendicularly substantially halves the ball. To secure the tether to the ball, a first end of the single-strap tether enters and passes through the entry through bore (the trailing end of the strap, a second end, does not pass through the ball) and then enters and passes through the exit through bore creating a first extent extending from the exit through bore and a second extent of the single-strap tether extending from the entry through bore. To secure the tether, a portion of the first extent passes through the suspension ring such that the first end is directed towards and approaches the ball. The second extent passes through the suspension ring overlapping against and capturing a portion of the first extent between a corresponding portion of the second extent. The second extent may be secured in overlapping engagement to the first extent proximate the suspension ring and also proximate the first end and the second end of the strap, thereby reinforcing the single-strap tether (as described, the overall thickness of the tether may be four thicknesses of the strap). With this exemplary embodiment of the tether, the tether is firm, but not hard, and somewhat flexible to have shock-absorbing properties such that it will withstand wear and tear and will not impart the unnatural recoil sting that may be imparted by a rigid metal rod or a metal chain when the ball is not hit or struck squarely, but the tether is hit or struck. Of course, this exemplary embodiment works with non-inflatable balls through which the through bores may be constructed.

For inflatable balls such as tetherballs, volleyballs, soccer balls, footballs, kick balls, and the like, and hollow balls such as tennis balls, racquetballs, handballs, squash balls, pickleballs, wiffle balls, and the like, as well as for some solid or non-inflated balls such as golf balls, lacrosse balls, street hockey balls, field hockey balls, and the like, a suitable attachment eyelet may be secured to the ball that serves as an anchor to which the tether may be attached.

The ball-hitting trainer of the present invention also may have one or more of several features that address various aspects of assembly, disassembly, and operation parameters of the device to facilitate the emulation of natural ball movement and trajectories as well as consistent repeatable performance to build desirable muscle memory. Such features may include, but not be limited to, one or more of the following: an in-line shock-absorbing impact-recoil feature; an in-line stop feature, an anchoring feature, and an in-line tensioner.

Some exemplary embodiments may have an in-line shock-absorbing impact-recoil feature positioned within the upper portion of the inclined line and for absorbing impact force of the ball tether assembly on the in-line shock-absorbing impact-recoil feature, thereby minimizing the impact force on the second stanchion and thereby also imparting recoil force to the ball tether assembly returning the ball tether assembly downward along the rope line toward the lower portion of the inclined line. The in-line shock-absorbing impact-recoil feature, in one exemplary embodiment, comprises a lower stop, an upper stop spaced from the lower stop, and an impact-receiving mass slidably engaging the inclined line and movable between the lower stop and the upper stop. The lower and upper stops need not be the same type of stop, and each may be of any suitable stop presently known. In fact, each of the lower stop and upper stop may be as simple as a knot tied in the rope line. Though not necessary, it is preferred that the lower stop (or knot) be small enough that the interior opening of the suspension ring (an inner diameter of the suspension ring) may pass over the lower stop to permit the suspension ring to strike the impact-receiving mass, thereby permitting the suspension ring to impart momentum to the impact-receiving mass causing it to travel up the inclined line towards the upper stop. Depending upon the mass of the impact-receiving mass and the impact force of the suspension ring together with the momentum of the tethered ball, the suspension ring may immediately recoil and start its return towards the user, or it may continue traveling a short distance up the inclined line until it loses it upward momentum, or it may again strike the impact-receiving mass which causing the suspension ring to recoil and start its return towards the user.

The impact-receiving mass may be of any suitable type, size, and weight. Though it is not necessary that the impact-receiving mass be symmetrical about a central through bore, it is preferred because it is less likely that it will cause undesirable resonance or vibration to the inclined line. In one exemplary embodiment of the impact-receiving mass, the impact-receiving mass is a spherical mass such as a ball having the central through bore with a diameter larger than the outer diameter for the rope line, but smaller than the lower and upper stops.

Further, by adjusting the distance between the lower stop and the upper stop (easily done if they are each knots in the rope line) and/or changing the impact-receiving mass (for example, to a lighter weight mass or a heavier weighted mass) the in-line shock-absorbing impact-recoil feature may be adjustable to accommodate differing types of ball tethering assemblies. For example, a baseball ball tether assembly may be interchangeably used with golf ball, soccer ball, and softball ball tether assemblies to accommodate multiple users and/or a single user developing multiple-sport skills.

The in-line stop feature may be positioned within the lower portion of the inclined line and its principal purpose is to stop downward movement of the ball tether assembly, thereby allowing the ball tether assembly to rest suspended from the inclined line and against the in-line stop feature. The in-line stop feature may be permanently positioned on the inclined line, or as in some exemplary embodiments, the in-line stop feature may be adjustable to any of multiple positions along the inclined line within the lower portion of the inclined line. This adjustability complements the versatility of the ball-hitting trainer by accommodating users of different heights and/or different ball tether assemblies. For example, a user that is six-foot tall will have a different level swing height from the ground than a four-foot tall user. Also, for example, the length of the tether of a ball tether assembly may or may not be adjustable. If the tether length is not adjustable, being able to adjust the position of the in-line stop up or down the inclined line enables the adjustment to the proper height of the ball either above the ground or so that the ball rests on the ground (for example, it may be desired that a golf ball tether assembly or a football tether assembly rest on the ground or on a tee in/on the ground and it may be desired that a soccer ball tether assembly rest on the ground or at various heights above the ground) without adjusting the length of the tether.

One exemplary embodiment of an in-line stop feature comprises a stopping mass having a central conduit through which the rope line is looped around the stopping mass and through the central conduit. Such looping of the rope line around the stopping mass enables the adjustable positioning of the stopping mass up and down the inclined line. By loosening the looped rope line, the stopping mass may advance upward or downward along the inclined line to a desired position. The stopping mass may be secured in the desired position by drawing the looped rope line taut around the stopping mass.

Being able to keep the inclined line under proper tension over time is desirable because rope lines may stretch or shrink due to temperature changes, adjusting the in-line stop feature and/or the in-line shock-absorbing impact-recoil feature may cause the inclined line to stretch, and over time gravity upon the components connected to the inclined line also may cause the inclined line to stretch. Certainly, an inclined line that is not maintained taut, but sags, will negatively affect the performance of the ball-hitting trainer. For this reason, an in-line tensioner positioned on the inclined line either below the in-line stop feature on the inclined line or, depending upon the height of the tall stanchion, above the in-line shock-absorbing impact-recoil feature may be advantageous to readily maintain the proper tension in the inclined line.

In some exemplary embodiments the in-line tensioner may be connected to the short-height stanchion and/or the tall-height stanchion, or the in-line tensioner may connect directly only to the rope line. One exemplary embodiment for the in-line tensioner comprises an engaging/disengaging ratchet mechanism, for example a fence line tensioner having an axle with a slot rotatably held within a frame, wherein the axle has a crank handle attached and a ratchet gear and pawl allow the axle to be rotated one direction and after releasing the pawl the axle may rotate the opposite direction, the frame has through holes so that the rope line may pass through one of the through holes, then through the slot, and then through another through hole. With this configuration, the turning of the crank handle in the direction permitted by the ratchet gear and pawl will wind the rope line around the axle, tightening the rope line, and to loosen the rope line the pawl is released from locking engagement with the ratchet gear so that the axle may reverse its rotation to loosen the rope line.

These and other features of the present invention will become more fully apparent from the following description or may be learned by the practice of the invention as set forth hereinafter.

BRIEF DESCRIPTION OF THE DRAWINGS

For the above-recited and other features and advantages of the invention to be readily understood, a more particular description of the invention briefly described above will be rendered by reference to specific embodiments thereof which are depicted or illustrated in the appended figures. Understanding that these depictions and drawings show only typical embodiments of the invention and should not be considered limiting of its scope, the invention will be described and explained with additional specificity and detail with reference to the accompanying figures in which:

FIG. 9A is a perspective view showing the tether strap having a first end threaded through the entry bore and then returned through the exit bore. FIG. 9B is a side perspective view showing how the first end and a second end of the tether strap pass through the suspension ring with directional arrows showing the threading maneuver through the suspension ring. And FIG. 9C is a side perspective view of the ball tether assembly fully assembled, secured by stitching, and tethering the ball to the suspension ring.

Figure 1:
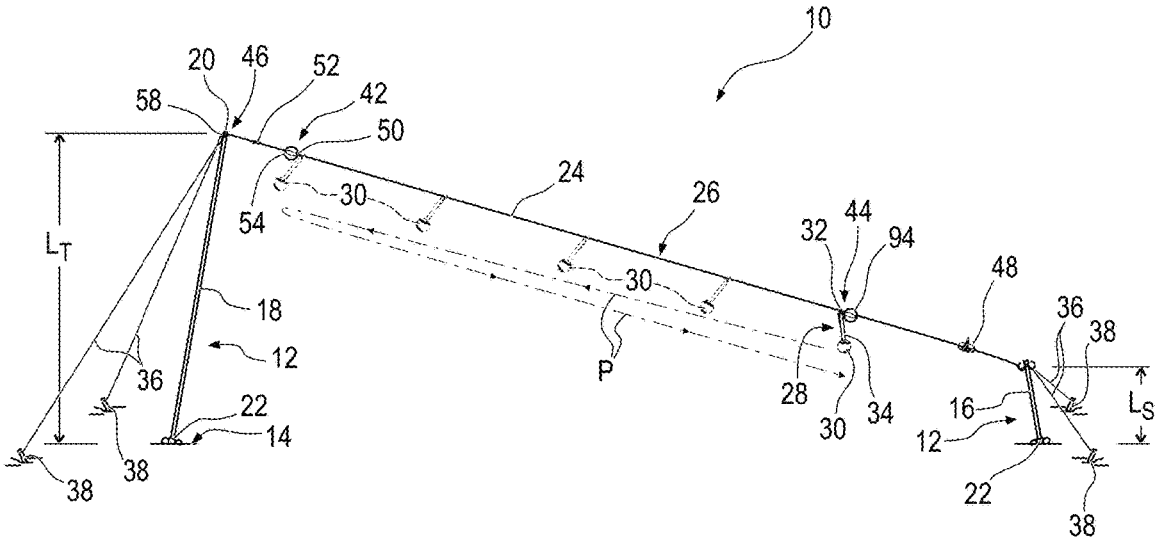
FIG. 1 is a perspective view of an exemplary embodiment of a multi-functional, shock-absorbing ball-hitting trainer showing a ball-traveling path in dashed line indicating that the ball, when struck by a batter, travels up the inclined line and returns back to the batter.

REFERENCE NUMBERS ball-hitting trainer 10
stanchion(s) 12
support surface 14
first stanchion (or short-height stanchion) 16
second stanchion (or tall-height stanchion) 18
apex 20
base 22
rope line 24
inclined line 26
ball tether assembly 28
ball 30
suspension ring 32
tether 34
guy line(s) 36
stake(s) 38
base holder 40
in-line shock-absorbing impact-recoil feature 42
in-line stop feature 44
anchoring feature 46
in-line tensioner 48
lower stop 50
upper stop 52
impact-receiving mass 54
knot(s) 56
dual eyelet(s) 58
batter 60
spikes 62
pole segment(s) 64
uppermost pole segment(s) 66
intermediate pole segment(s) 68
base pole segment(s) 70
dual hooks 72
single spike 74
female end 76
male end 78
soccer ball tether assembly 80
golf ball tether assembly 82
soccer ball 84
attachment eyelet 86
ballast bottom 88
receiving tube 90
golf ball 92
stopping mass 94
central conduit 96
loop threading 98
entry bore 100
exit bore 102
single-strap tether 104
first end 106
second end 108
first extent 110
second extent 112
stitching 113
engaging/disengaging ratchet mechanism 114
axle 116
slot 118
frame 120
crank handle 122
ratchet gear 124
pawl 126

-continued through hole(s) 128
launch angle A
directional arrows $A_D$
threading arrows $A_T$
run distance $D_R$
footprint length $L_F$
length (of the first stanchion) $L_S$
length (of the second stanchion) $L_T$
ball-traveling path P
initial travel path direction $P_D$
footprint width $W_F$

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the figure(s), is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

The invention of the present disclosure is quite versatile, making single user (or multiple users taking turns) training practice adjustable to fit the user(s), portable so that the trainer may be assembled, disassembled, transported from one location to another, interchangeable to accommodate training for multiple sports, having features that enhance the trainer's performance, and having a relatively small footprint so that assembly may be completed in more locations than other such training devices. Obviously, every different situation should not be described in this disclosure when a representative example will sufficiently teach the invention and how it is used for not only the representative example(s) but for many other uses that will be readily apparent to those of ordinary skill in the art who have been informed and taught by this disclosure. Consequently, for the sake of brevity and without compromising or limiting the teachings herein, the invention of this disclosure will be described in reference to exemplary, representative situations. Thus, the following detailed description of the embodiments of the representative example(s) of the present invention, as depicted in the figure(s), is not intended to limit the scope of the invention, as claimed, but is merely representative of one of many presently contemplated embodiments of the invention.

Figure 2:
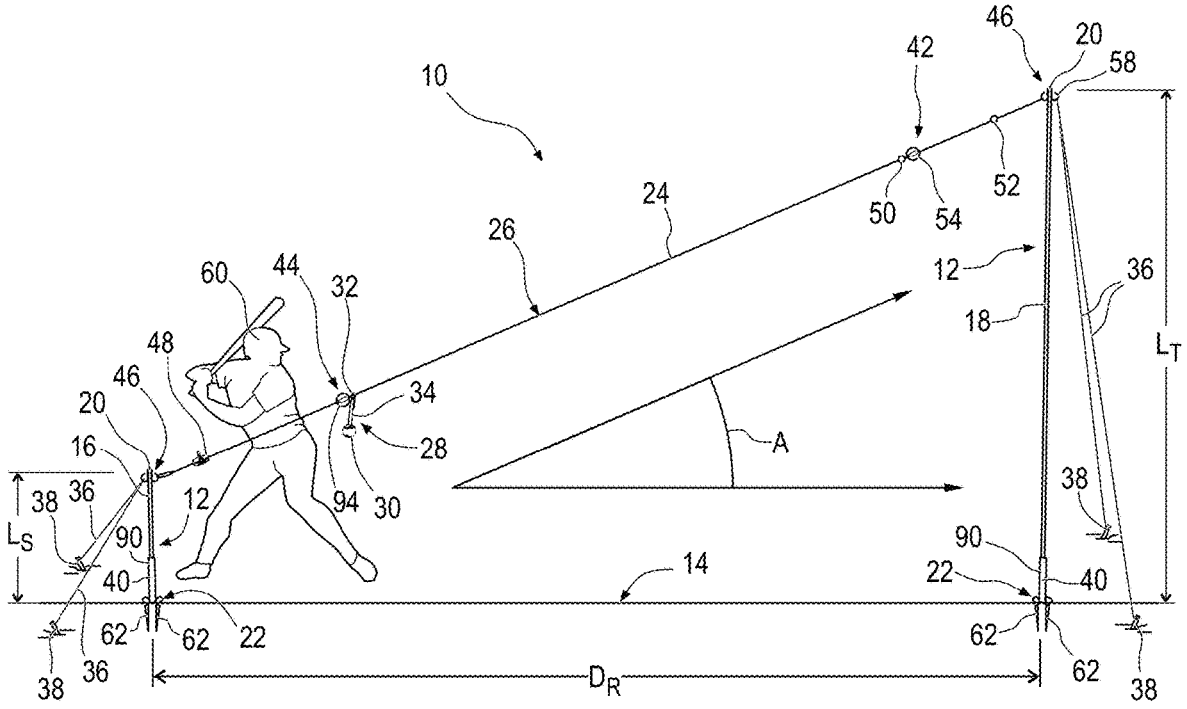
FIG. 2 is a perspective view of the exemplary embodiment of the multi-functional, shock-absorbing ball-hitting trainer assembled to show the inclined line disposed at an optimal angle and a batter outlined in a ready-to-hit pose.
Figure 3:
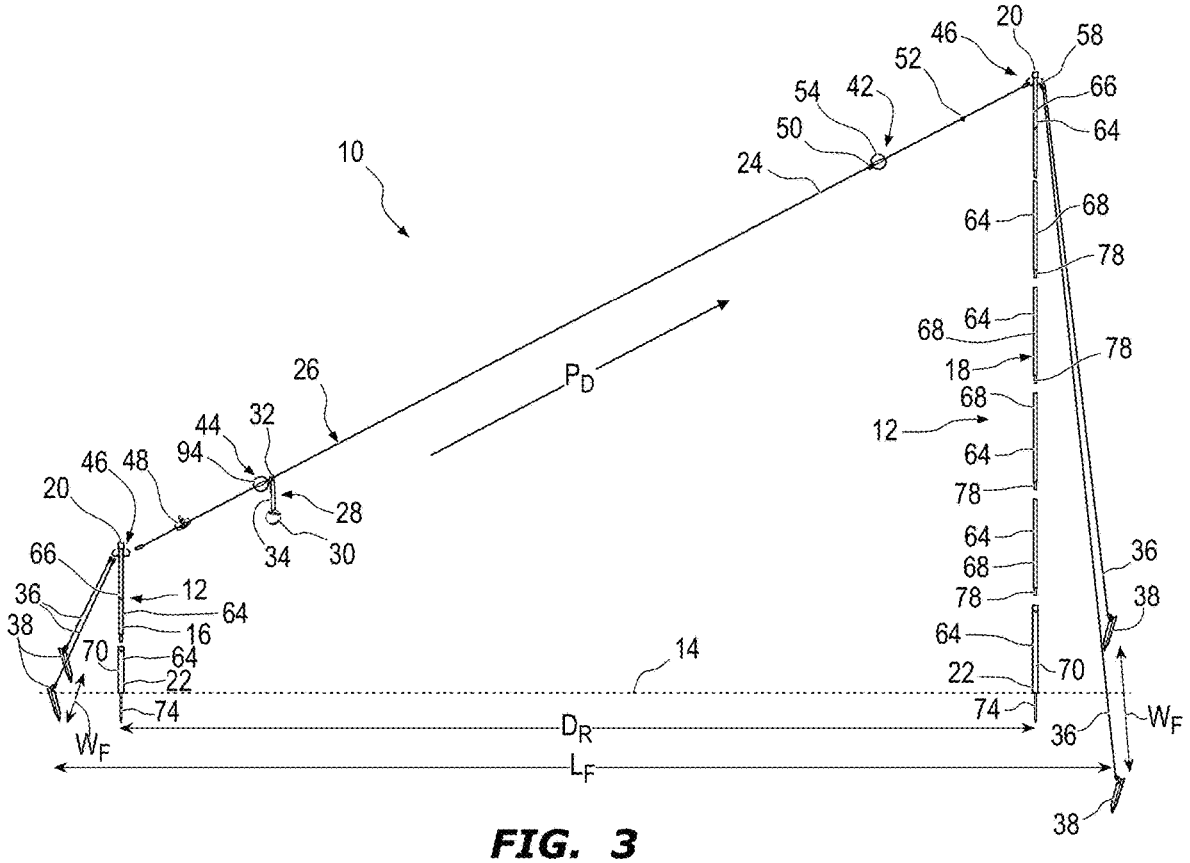
FIG. 3 is an exploded view of the exemplary embodiment of the multi-functional, shock-absorbing ball-hitting trainer with certain identified dimensions designated by arrows.

FIG. 1 is a perspective view of an exemplary embodiment of a multi-functional, shock-absorbing ball-hitting trainer showing a ball-traveling path P as a dashed-line arrow indicating that the ball, when hit by a batter, travels up the inclined line and returns back towards the batter. The ball-hitting trainer 10 of the present invention has stanchions 12 mountable on a support surface 14 (such as the ground)

to be disposed upright. The stanchions 12 comprise a first stanchion 16 and a second stanchion 18, each stanchion 12 having an apex 20 and a base 22. The second stanchion 18 is greater in length LT than the length Ls of the first stanchion 16. The base 22 of each stanchion 12 being supportable upon the support surface 14 so that the apex 20 of each stanchion 12 is spaced above the support surface 14. As shown in FIGS. 2 and 3, the base of the first stanchion 16 may be positioned a run distance $D_R$ from the position of the second stanchion 16.

For purposes of this application the term "upright" when used to describe the disposition of the stanchions 12 means having a vertical component from base 22 to apex 20 so that the apex 20 is spaced above the base 22, and that the disposition need not be perpendicular to the support surface 14 but can be perpendicular (as shown in FIG. 2). There may be times when tilting of the stanchions 12 at a slightly acute angle from vertical may be advantageous, particularly if they are disposed to tilt in opposite directions from each other or toward each other (as shown in FIG. 1).

The ball-hitting trainer 10 of FIG. 1 further comprises a rope line 24 that may have one end secured to the first stanchion 16 at its apex 20 and the other end secured to the second stanchion 18 at its apex 20, thereby creating an inclined line 26. The rope line 24/inclined line 26 may be made of any suitable material such as a plastic rope (made from nylon, polyester, polyethylene, polypropylene, or any other plastic or combination of plastics), Kevlar® rope, a metal fiber rope, and the like. Nylon rope is particularly suitable as the inclined line 26 because, it is relatively lightweight, it is very strong and can absorb large shock loads, is clastic and has a high level of toughness, is resistant to rot, mildew, UV rays, oil, gasoline, and most chemicals, has good abrasion resistance, is lustrous, dries quickly, and does not absorb water. Nylon rope also has a high service temperature and a low coefficient of friction. Any rope that exhibits several of the characteristics that nylon rope does likely will be suitable for use as an inclined line 26.

A ball tether assembly 28 is suspended in slidable engagement from the inclined line 26, allowing the ball tether assembly 28 to travel up and down the inclined line 26 when reacting to a force acting upon the ball tether assembly 28. The ball tether assembly 28 comprises a ball 30, a suspension ring 32, and a tether 34 secured between the ball 30 and the suspension ring 32. As depicted in FIG. 1, the ball-traveling path P shown as a dashed-line arrow indicates that the ball 30, when hit by a batter (not shown in FIG. 1), travels up the inclined line 26 and returns back towards the batter.

Figure 6:
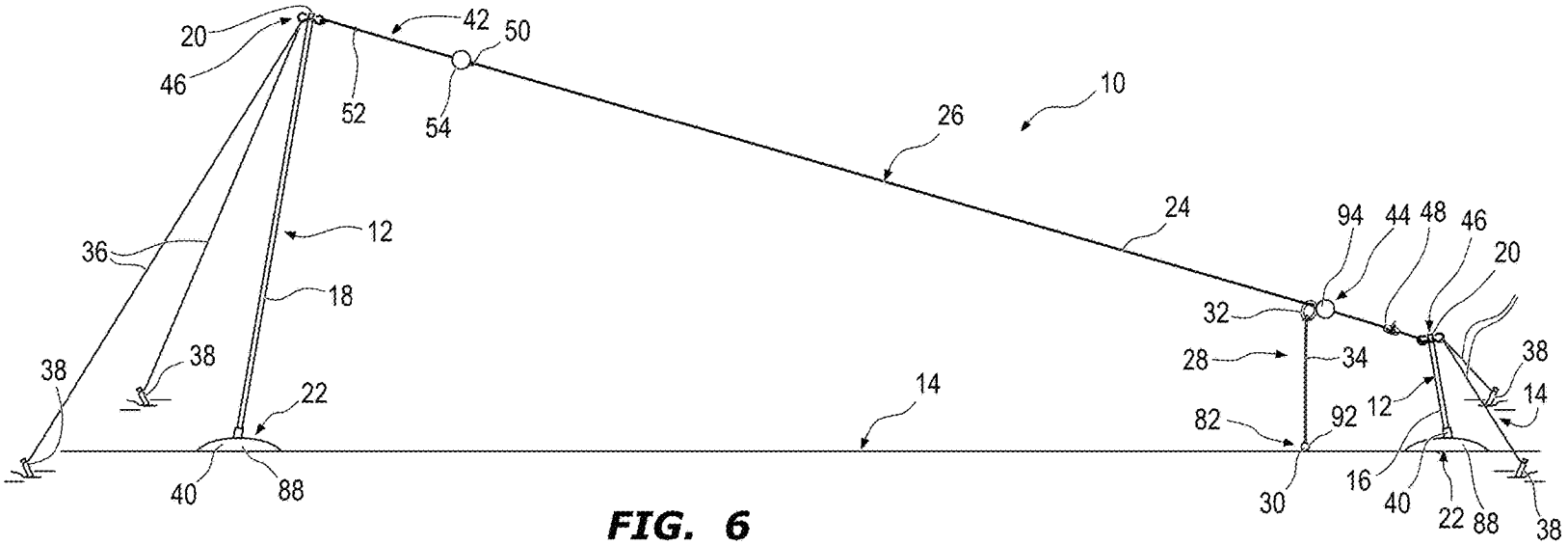
FIG. 6 is a perspective view of another exemplary embodiment of the multi-functional, shock-absorbing ball-hitting trainer configured to accommodate a golf ball.
Figure 7:
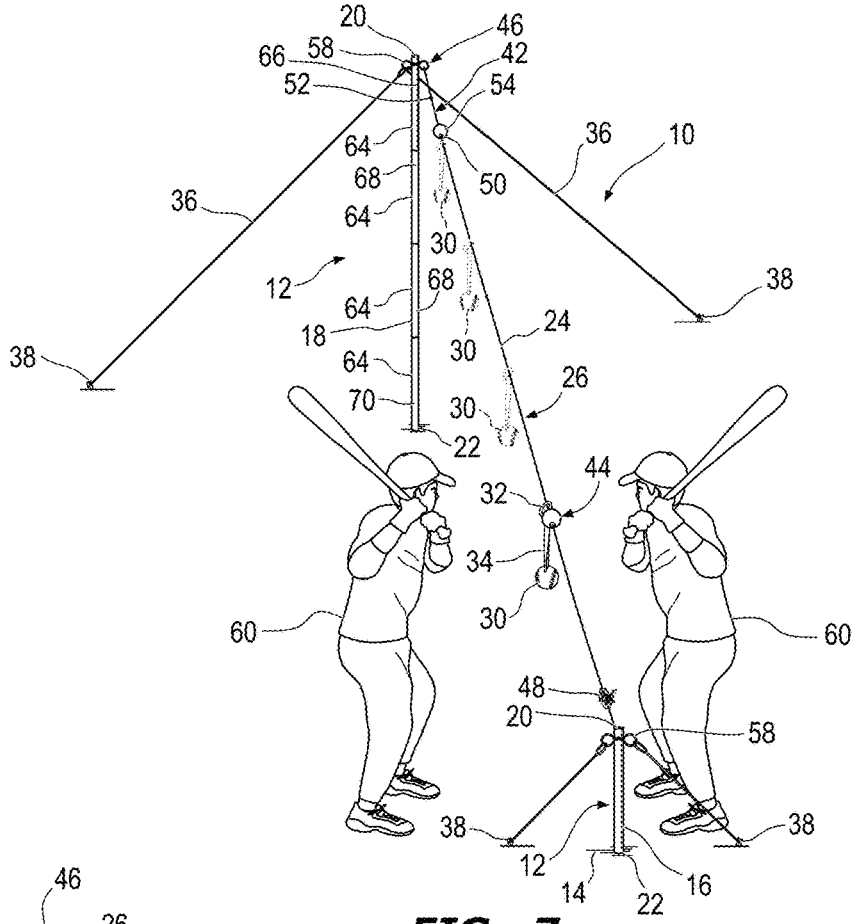
FIG. 7 is a perspective rear view of an exemplary embodiment of the multi-functional, shock-absorbing ball-hitting trainer showing batters (in outline) positioned on both sides of the inclined line (one batting righthanded and other batting lefthanded) to illustrate user-position diversity.

To stabilize freestanding stanchions 12 and the inclined line 26, guy lines 36 may be secured to each stanchion 12 at the apex 20 and anchored to the ground using stakes 38 (or by tying the guy line 36 to some ad hoc substitute such as a tree, a large rock, leg of a picnic table or any other suitably sturdy substitute for a stake 38). The base 22 of each stanchion 12 may rest on the support surface 14 (ground, as shown in FIGS. 1 and 7) or may be received into a base holder 40 (such as shown in FIGS. 2 and 6).

As depicted throughout the FIGS., particularly FIGS. 1-3, 5-8, and 11-15, The ball-hitting trainer 10 of the present invention also may have one or more of several features that address various aspects of assembly, disassembly, and operation parameters of the ball-hitting trainer to facilitate the emulation of natural ball movement and trajectories as well as consistent repeatable performance to build desirable muscle memory. Such features may include, but not be limited to, one or more of the following: an in-line shock-absorbing impact-recoil feature 42; an in-line stop feature 44, an anchoring feature 46, and an in-line tensioner 48.

Figure 13:
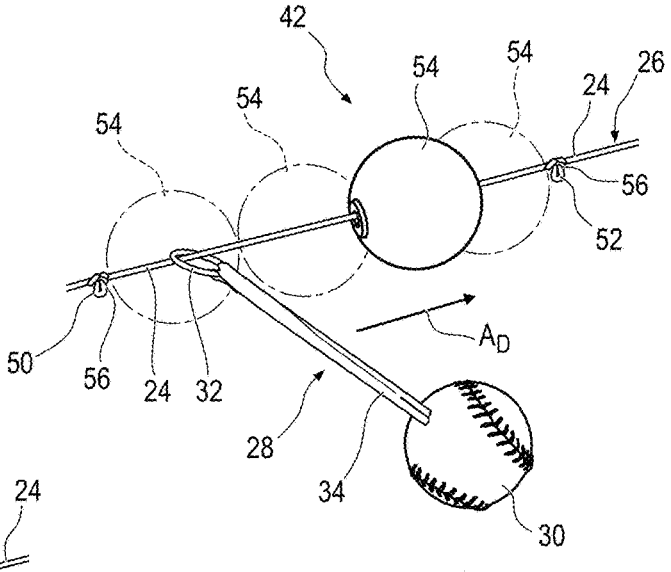
FIG. 13 is a perspective close-up view of the same portion of the inclined line shown in FIG. 12 depicting a shock-absorbing ball post-impact from the ball tether assembly as it travels along the inclined line towards an upper knot stop, wherein the travel path of the shock-absorbing ball is depicted in phantom lines at differing positions along the travel path.
Figure 12:
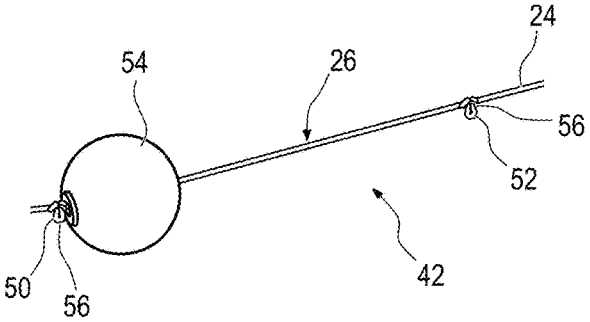
FIG. 12 is a perspective close-up view of another portion of the inclined line depicting a shock-absorbing ball resting against a lower knot stop and positioned for impact from the ball tether assembly.

An exemplary embodiment of the in-line shock-absorbing impact-recoil feature 42 is depicted in FIGS. 1-3, 5-7, and 12-13 and comprises a lower stop 50, an upper stop 52 spaced from the lower stop 50, and an impact-receiving mass 54 slidably engaging the inclined line 26 and movable between the lower stop 50 and the upper stop 52. FIG. 12 is a perspective close-up view the inclined line 26 and the impact-receiving mass 54 pre-impact wherein the impact-receiving mass 54 rests against the lower stop 50 positioned for impact from the ball tether assembly 28. The lower and upper stops 50, 52 need not be the same type of stop, and each may be any suitable stop presently known. In fact, as depicted throughout the FIGS., each of the lower stop 50 and upper stop 52 may be as simple as a knot 56 tied in the rope line 24. Though not necessary, it is preferred that the lower stop 50 (or knot 56) be small enough that the suspension ring 32 having an interior opening (an inner diameter of suspension ring 32) may pass over the lower stop 50 to strike the impact-receiving mass 54, thereby permitting the suspension ring 32 to impart momentum to the impact-receiving mass 54 causing it to travel up the inclined line 26 towards the upper stop 52. Depending upon the mass of the impact-receiving mass 54 and the impact force of the suspension ring 32 together with the momentum of the tethered ball 30, the suspension ring 32 may immediately recoil and start its return towards the user, or it may continue traveling a short distance up the inclined line 26 until losing its upward momentum (see FIG. 13 showing the impact caused movement of the impact-receiving mass 54 in phantom lines), or it may again strike the impact-receiving mass 54 which causing the suspension ring 32 to recoil and, with the assistance of gravitational pull, starts its return towards the user. Of note is the fact that the ball 30 does not impact the impact-receiving mass 54 directly. Rather, the suspension ring 32 (with mass much less than the mass of the ball 30) impacts the impact-receiving mass 54. Because the suspension ring 32 is connected to the ball 30 through the tether 34, the momentum of the ball 30 continues to pull the suspension ring 32 along the inclined line 26 to impact, whereby momentum of the ball 30 is imparted to the impact-receiving mass 54 without the ball 30 actually striking the impact-receiving mass 54. Hence, the momentum of the ball 30 dissipates rapidly as the impact-receiving mass 54 absorbs the shock of the impact, allowing the ball 30 to reverse course due to recoil and/or gravity to travel down the inclined line 26. Movement of the ball tether assembly 28 along the inclined line 26 is also depicted in phantom lines showing multiple ball tether assemblies 28 at various positions during movement.

By adjusting the distance between the lower stop 50 and the upper stop 52 (easily done if they are each knots 56 in the rope line 24) and/or changing the impact-receiving mass 54 (for example, to a lighter weight mass or a heavier weighted mass) the in-line shock-absorbing impact-recoil feature 42 may be adjustable to accommodate differing types of ball tethering assemblies. For example, a baseball ball tether assembly 28 may be interchangeably used with golf ball, soccer ball, and softball ball tether assembly 28 to accommodate multiple users and/or a single user developing multiple-sport skills.

The in-line stop feature 44 may be positioned within the lower portion of the inclined line 26 and its principal purpose is to stop downward movement of the ball tether assembly 28, thereby allowing the ball tether assembly 28 to rest suspended from the inclined line 26 and against the in-line stop feature 44. The in-line stop feature 44 may be permanently positioned on the inclined line 26, or as in some exemplary embodiments, the in-line stop feature 44 may be adjustable to any of multiple positions along the inclined line 26 within the lower portion of the inclined line 26. This adjustability complements the versatility of the ball-hitting trainer 10 by accommodating users of different heights and/or different ball tether assemblies 28. For example, a user that is six-foot tall will have a different level swing height from the ground than a four-foot tall user. Also, for example, the length of the tether 34 of a ball tether assembly 28 may or may not be adjustable. If the tether 34 length is not adjustable, being able to adjust the position of the in-line stop feature 44 up or down the inclined line 26 enables the adjustment to the proper height of the ball 30 a working distance from the inclined line 26, either above the ground or so that the ball 30 rests on the ground (for example, it may be desired that a golf ball tether assembly 28 rest on the ground or on a tee in the ground and it may be desired that a soccer ball tether assembly 28 rest on the ground or at various heights above the ground) without adjusting the length of the tether 34.

Figure 4:
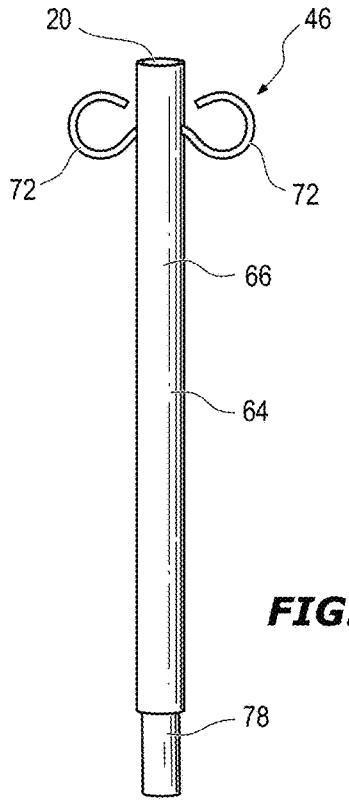
FIG. 4 is a side view of an exemplary embodiment of an uppermost pole segment having opposing anchoring fixtures.

Each of the stanchions 12 has an anchoring feature 46 that comprises at least part of the connection of the rope line 24 to the stanchion 12. In some embodiments, each stanchion 12 may have one or more anchoring features 46 and such anchoring features may be positioned at any desired height along the stanchion 12 from its base 22 to its apex 20 either being movable up and down and then securely fixed to the stanchion 12 or multiple being secured along the stanchion 12 at various desired heights. The anchoring feature 46 may be of any suitable type so long as it facilitates the secure connection of the rope line 24 to the stanchion 12, such as for example and not as limiting the types including, moorings, mooring cleats, rope cleats, clips, eyelets, dual eyelets, hooks, dual hooks, snap hooks, clamps, anchor rings, carabiners, cable fasteners, and the like. As depicted in FIG. 1, the anchoring features 46 are dual eyelets 58. As an exemplary alternative, dual hooks are shown in FIG. 4.

The in-line tensioner 48 is another feature of the ball-hitting trainer 10 shown in FIG. 1. Being able to keep the inclined line 26 under proper tension over time, without requiring the rope line 24 disconnection and reconnection, is desirable because rope lines 24 may stretch or shrink due to temperature changes, adjusting the in-line stop feature 44 and/or the in-line shock-absorbing impact-recoil feature 42 may cause the inclined line 26 to stretch or become longer or shorter due to the adjustment, and over time gravity upon the components connected to the inclined line 26 also may cause the inclined line 26 to stretch. Certainly, an inclined line 26 that is not maintained taut, but sags, will negatively affect the performance of the ball-hitting trainer 10. For these reasons, an in-line tensioner 48 is positioned on the inclined line 26 either below the in-line stop feature 44 on the inclined line 26 or, depending upon the height of the second stanchion 18, above the in-line shock-absorbing impact-recoil feature 42 may be advantageous to readily maintain the proper tension in the inclined line 26. Furthermore, after training session usage of the ball-hitting trainer 10, depending on the composition of the rope line 24, proper maintenance of the rope line 24 may require the tension on the rope line 24 to be loosened between training sessions.

FIG. 2 is a perspective view of an alternative exemplary embodiment of the multi-functional, shock-absorbing, ball-hitting trainer 10 assembled to show the inclined line 26 disposed at an optimal launch angle A and a batter 60 outlined in a ready-to-hit pose. Because the inclined line 26 defines a launch angle A at which the ball 30 reacts when hit/struck properly, as depicted in FIG. 2, given the heights of the first stanchion 16 and the second stanchion 18 the run distance $D_R$ between the stanchions 12 may be set so that the launch angle A is optimized. To develop muscle memory through training, the optimal launch angle A for developing line drive hitting muscle memory is 20°-30°.

FIG. 2 is an exemplary embodiment showing the stanchions 12 disposed vertically with the base 22 of each stanchion 12 being secured by a base holder 40 with spikes 62 driven into the ground so that the stanchions 12 are spaced apart the run distance $D_R$ needed for the inclined line 26 to be disposed at an optimum launch angle A (20°-30° for line drive training and other angles for other training situations).

Of course it should be understood that the launch angle A may be adjustable to better emulate line drives or fly balls for users of all ages, shapes, sizes, and abilities. Such adjustability may be accomplished by varying the spaced run distance $D_R$ and/or by adjusting the relative heights of the stanchions 12. FIG. 3 is an exploded view of the exemplary embodiment of the multi-functional, shock-absorbing ball-hitting trainer 10 with height-adjustable stanchions 12 having one or more pole segments 64. The pole segments 64 may be of equal or non-equal lengths and may comprise an uppermost pole segment 66, intermediate pole segments 68, and/or a base pole segment 70, wherein the uppermost pole segment 66 may have the anchoring feature 46 connected thereto (as depicted in FIG. 4 where the anchoring feature 46 comprises dual hooks 72) and the base pole segment 70 may be drivable into the support surface 14 (e.g., the ground) and secured by a single spike 74.

FIG. 3 also identifies certain dimensions and aspects of the ball-hitting trainer 10; namely, the run distance $D_R$, a footprint length $L_F$ (the overall length required for assembly of the ball-hitting trainer 10), a footprint width $W_F$ (the overall width required for assembly of the ball-hitting trainer 10) each designated by double arrows and the initial travel path direction $P_D$ (the general direction the ball 30 travels initially after launch) designated by a directional arrow.

Also, as depicted in FIG. 3 and in FIG. 4 with respect to the uppermost pole segment 66 shown enlarged, certain pole segments 64 are designed to be assembled by telescopic engagement with other pole segments 64. Those certain pole segments 64 (which include the intermediate pole segments 68) may have a female end 76 having a receiving inner diameter and a male end 78 having a tapered outer diameter. Depending on the specific exemplary embodiment, the uppermost pole segments 66 and the base pole segments 70 may have a female end 76 and/or male end 78 (by way of examples only, an uppermost pole segment 66 may have a male end 78 but may be capped off or enclosed at its opposite end, and a base pole segment 70 may have a female end 76 but a single spike 74 at its opposite end (as shown in FIG. 3)).

Although the FIGS. show the anchoring features 46 positioned at the apex 20 and/or the base 22, it should be understood that one or more anchoring features 46 may be positioned anywhere along the length of the stanchions 12, as desired, and may be movable long the stanchion 12 or secured at intervals to provide adjustability of height positioning, thereby giving the user the ability to change launch angles and/or ball height.

FIG. 4 is an enlarged side view of an exemplary embodiment of an uppermost pole segment 66 having an anchoring feature 46 of opposing dual hooks 72. Having opposing dual hooks 72, the rope line 24 may be connected to one hook while guy lines 36 may be connected to the opposing hook.

Figure 5:
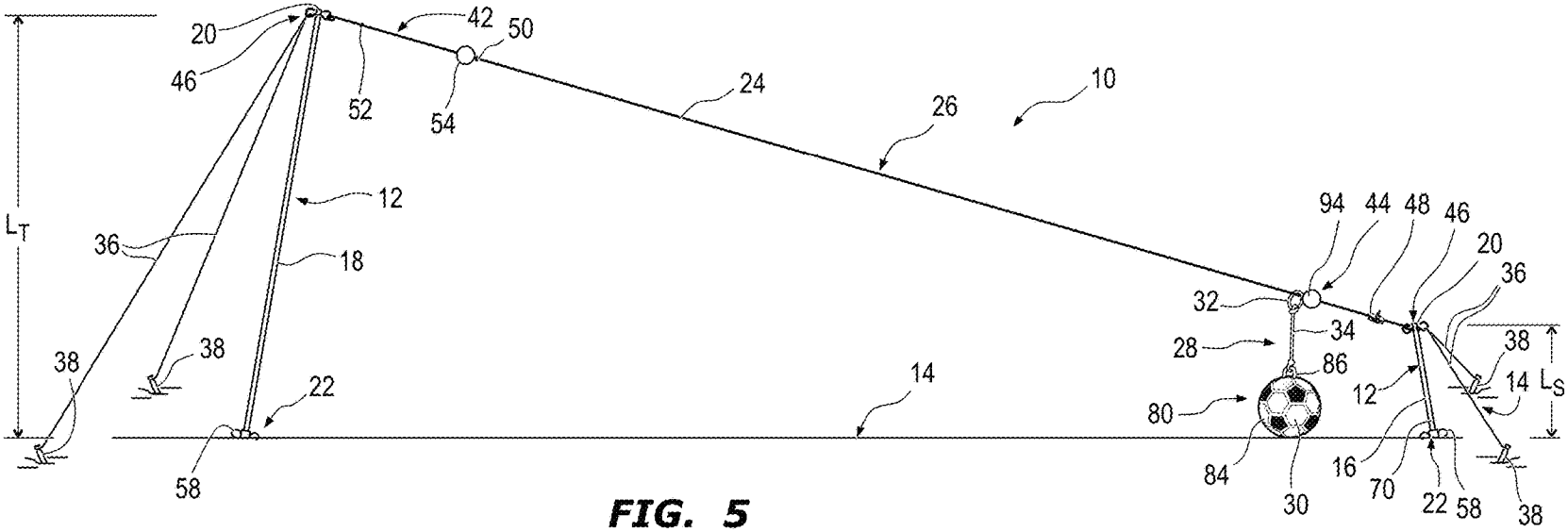
FIG. 5 is a perspective view of an alternative exemplary embodiment of the multi-functional, shock-absorbing ball-hitting trainer configured to accommodate a soccer ball.

FIGS. 5 and 6 are perspective views of representative alternative exemplary embodiments of the multi-functional, shock-absorbing ball-hitting trainer 10 configured to accommodate balls 30 other than baseballs or softballs. FIG. 5 depicts a ball-hitting trainer 10 configured with a soccer ball tether assembly 80. FIG. 6 depicts a ball-hitting trainer 10 configured with a golf ball tether assembly 82.

The soccer ball tether assembly 80 comprises a suspension ring 32, a soccer ball 84, and a tether 34 secured between the soccer ball 84 and the suspension ring 32. The soccer ball 84 of FIG. 5 is an inflatable ball 30. For inflatable balls such as tetherballs, volleyballs, soccer balls, kick balls, footballs, and the like, and hollow balls such as tennis balls, racquetballs, handballs, squash balls, pickleballs, wiffle balls, and the like, a suitable attachment eyelet 86 may be secured to the ball 30 that serves as an anchor to which the tether 34 may be attached. Further, if the soccer ball tether assembly 80 has a non-adjustable length tether 34, positioning the height of the soccer ball 84 a working distance from the inclined line 26, for example, either resting on the ground or elevated above the ground, may be accomplished by adjusting the in-line stop feature 44 up or down the inclined line 26.

As depicted in FIG. 5, an alternative exemplary base pole segment 70 comprising an anchoring feature 46 disposed and connected to the base pole segment 70 at ground level enabling the rope line 24 to be connected at ground level.

The golf ball tether assembly 82 comprises a suspension ring 32, a golf ball 92, and a tether 34 secured between the golf ball 92 and the suspension ring 32. The golf ball 92 of FIG. 6 is a non-inflatable ball 30, consequently, the tether 34 may either pass through the golf ball 92 or connect to a suitable attachment eyelet 86. Like the soccer ball assembly 80, if the golf ball tether assembly 82 has a non-adjustable length tether 34, positioning the height of the golf ball 92 a working distance from the inclined line 26, for example, either resting on the ground or elevated onto a tee above the ground, may be accomplished by adjusting the in-line stop feature 44 up or down the inclined line 26.

Also depicted in FIG. 6 is an alternative exemplary base holder 40 comprising a ballast bottom 88 and a receiving tube 90 that may be affixed rigidly at a desired angle (acute or normal) to the ballast bottom 88 or angularly adjustable.

However, an alternative configuration of the ball-hitting trainer 10 may be particularly suitable for golf training. With golf, a significant portion of the game involves getting loft when striking the golf ball with several shots a golfer may practice. When the rope line is connected to the anchoring feature 46 disposed at ground level (see FIG. 5) of the short-height stanchion 16 and the anchoring feature 46 is disposed at the apex 20 of the tall-height stanchion 18 the alternative configuration is created making the angle of the inclined line 26 significantly steeper, thereby more conducive to practicing getting loft on the golf ball.

FIG. 7 is a perspective rear view of an exemplary embodiment of the multi-functional, shock-absorbing ball-hitting trainer 10 showing batters 60 (in outline) positioned on both sides of the inclined line 26 (one batting righthanded and other batting lefthanded) to illustrate user-position versatility.

Figure 8:
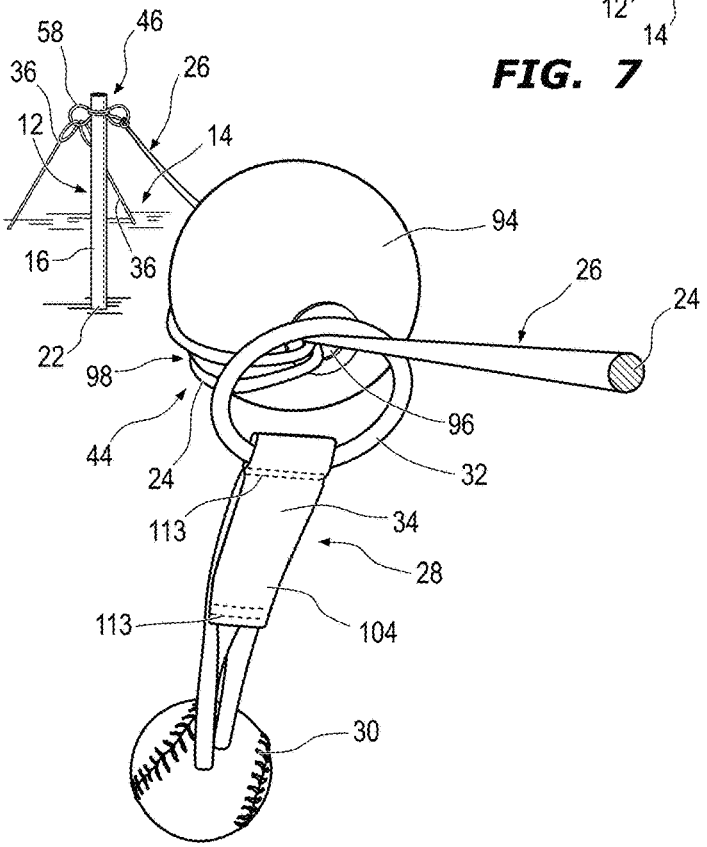
FIG. 8 is a perspective view of a portion of an exemplary embodiment of the multi-functional, shock-absorbing ball-hitting trainer showing a ball tether assembly resting against a height-adjustable in-line stop feature positioned to support a ball tether assembly at a desired height for the user.

FIG. 8 is a perspective view of a portion of an exemplary embodiment of the multi-functional, shock-absorbing ball-hitting trainer 10 showing a ball tether assembly 28 resting against a height-adjustable in-line stop feature 44 positioned to support the ball tether assembly 28 at a desired height for the user (see also FIG. 7 for context). The in-line stop feature 44 comprises a stopping mass 94 having a central conduit 96 through which the rope line 24 is looped around the stopping mass 94 and through the central conduit 96 such that when the rope line 24 looped around the stopping mass 94 is loose, the stopping mass 94 may advance upward or downward along the inclined line 26 to a desired position, and the stopping mass 94 is secured in the desired position by drawing the rope line 24 taut thereby also drawing taut the rope line 24 looped around the stopping mass 94.

Figure 11:
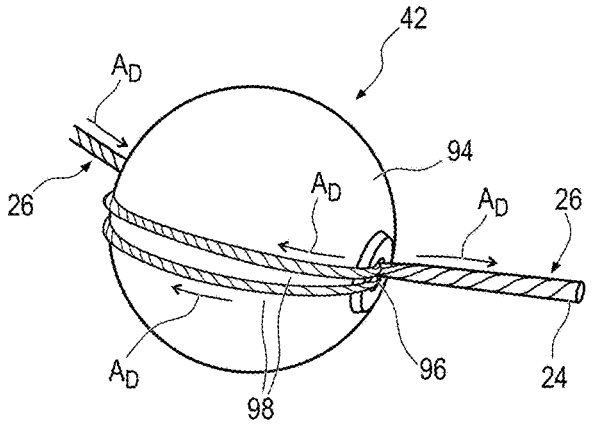
FIG. 11 is a perspective close-up view of a portion of the inclined line and showing the height-adjustable in-line stop feature with direction arrows depicting how the height-adjustable ball stop may be adjustably secured along the incline line.

FIG. 11 is a perspective close-up view of a portion of the inclined line 26 and showing the height-adjustable ball stop 44 with directional arrows $A_D$ depicting the loop threading 98 of the rope line 24 about the stopping mass 94 in an exemplary manner that permits the height-adjustable ball stop 44 to be adjustably moved and secured along the incline line 26.

Figure 9A:
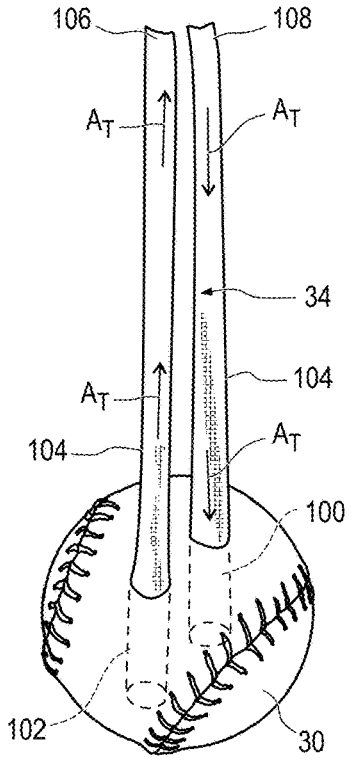
FIGS. 9A-C depict various views illustrating the assembly of an exemplary ball tether assembly, wherein the ball tether assembly comprises a ball having an entry bore and an exit bore, a suspension ring, and a tether strap connecting the ball to the suspension ring.
Figure 9B:
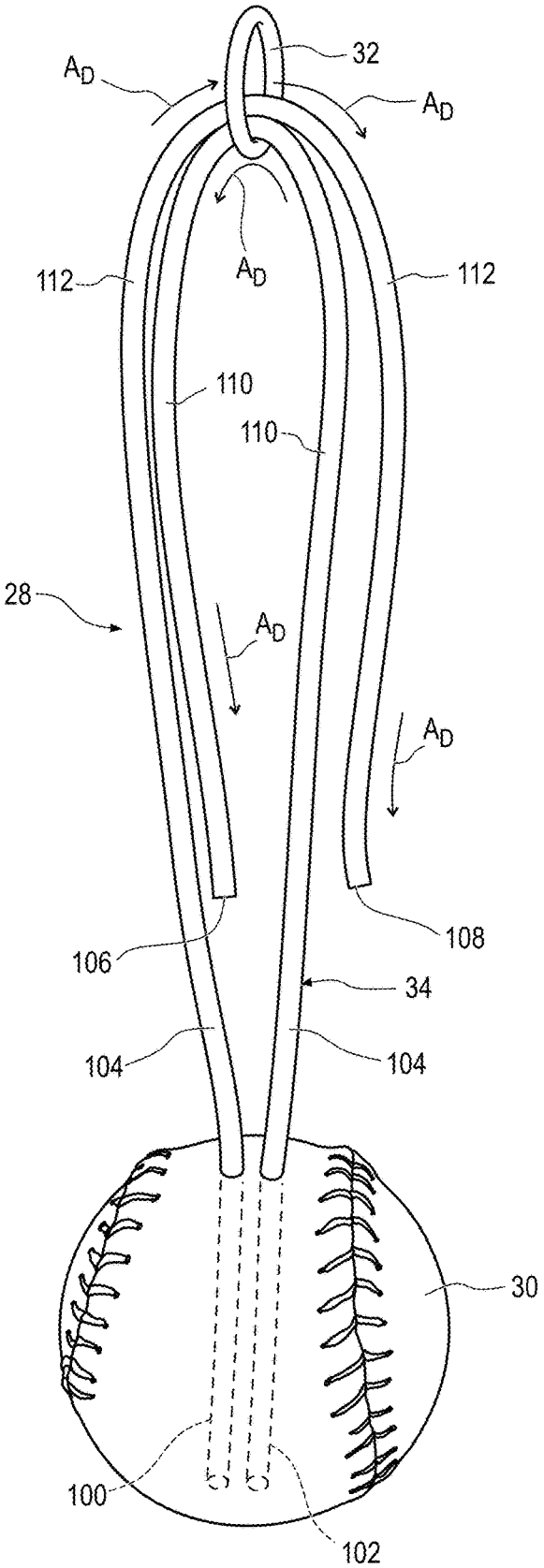
Figure 9C:
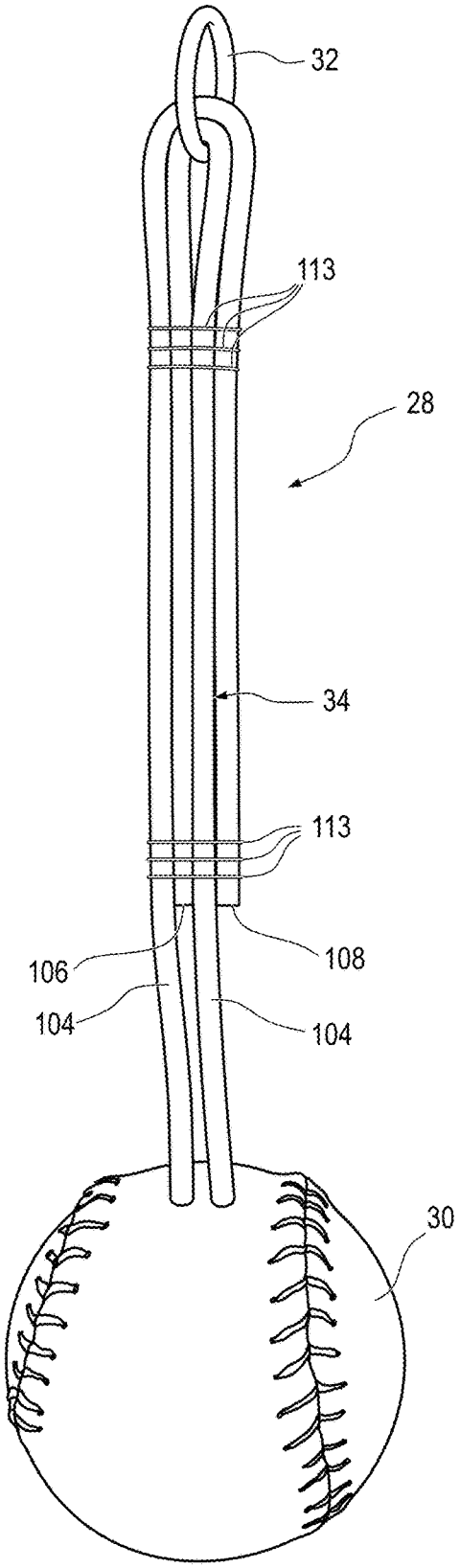

FIGS. 9A-C depict various views illustrating the assembly of an exemplary ball tether assembly 28, wherein the ball tether assembly 28 comprises a ball 30 having an entry bore 100 and an exit bore 102 (each bore shown in phantom lines), a suspension ring 32, and a tether 34. The tether 34, in the exemplary ball tether assembly 28 depicted, is a single-strap tether 104 (best shown as a strap in FIGS. 8 and 10) connecting the ball 30 to the suspension ring 32. FIG. 9A is a perspective view showing the single-strap tether 104 having a first end 106 threaded through the entry bore 100 and then returned through the exit bore 102. Threading arrows $A_T$ show an exemplary threading of the single-strap tether 104 through the ball 30. FIG. 9B is a side perspective view showing how the first end 106 and a second end 108 of the single-strap tether 104 pass through the suspension ring 32 with directional arrows $A_D$ showing the threading maneuver through the suspension ring 32. This threading maneuver determines the length of the tether 34 and positions the single-strap tether 104 for securement. FIG. 9C is a side perspective view of the ball tether assembly 28 fully assembled, as secured together, and tethering the ball 30 to the suspension ring 32.

The exemplary embodiment shown in FIGS. 9A-C, is a non-adjustable length tether 34. The tether 34 depicted is a single-strap tether 104 secured between the ball 30 and the suspension ring 32, comprising a strap having opposing ends, a length, a breadth, and a thickness. The ball 30 may have the two through bores, entry bore 100 and exit bore 102, lying in a first plane that substantially halves the ball 30. Each of the two through bores (entry bore 100 and exit bore 102) may be positioned substantially equidistant from a second plane (substantially perpendicular to the first plane) that perpendicularly substantially halves the ball. To secure the tether 34 to the ball 30, first end 106 of the single-strap tether 104 enters and passes through the entry bore 100 (the trailing end of the strap, a second end 108, does not pass through the ball 30) and then enters and passes through the exit bore 102 creating a first extent 110 extending from the exit bore 102 and a second extent 112 of the single-strap tether 104 extending from the entry bore 100. To secure the tether 34, a portion of the first extent 110 passes through the suspension ring 32 such that the first end 106 is directed towards and approaches the ball 30. The second extent 112 passes through the suspension ring 32 overlapping against and capturing a portion of the first extent 110 between a corresponding portion of the second extent 112. The second extend 112 may be secured in overlapping engagement to the first extent 110 proximate the suspension ring 32 and also proximate the first end 106 and the second end 108 of the strap, thereby reinforcing the single-strap tether 104 (as described, the overall thickness of the tether 34 may be four thicknesses of the strap). With this exemplary embodiment of the tether 34, the tether 34 is firm, but not hard, and somewhat flexible to have shock-absorbing properties such that it will withstand wear and tear and will not impart the unnatural recoil sting that may be imparted by a rigid metal rod or a metal chain when the ball 30 is not hit or struck squarely, but the tether 34 is hit or struck. Of course, this exemplary embodiment works with non-inflatable balls 30 through which the through bores 100, 102 may be constructed.

As depicted in FIGS. 8 and 9C, the securement is achieved using stitching 113, thereby rendering the single-strap tether 104 non-adjustable lengthwise. Hence, the height of the ball 30 may be adjustable by moving the height-adjustable in-line stop feature 44 upward or downward along the inclined line 26. However, it should be understood that if adjustability is desired in the length of the of the tether 34, that adjustability may be accomplished in any suitable manner, for example and not to be limiting, loop and hook (e.g., Velcro®) may be used for adjustability, or snaps, or clamps, or the like. Armed with this disclosure, those skilled in the art will know of several or many adjustable means for securement.

Figure 10:
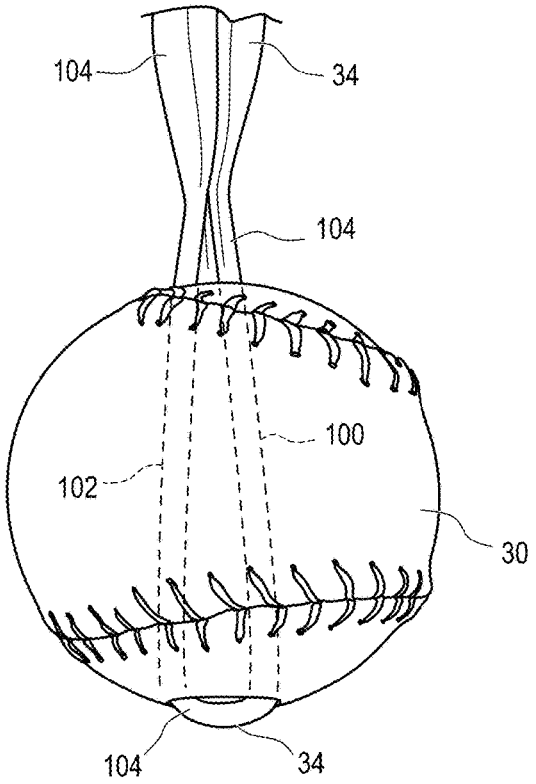
FIG. 10 is a perspective view of a portion of an exemplary ball tether assembly depicting the tether strap exiting the entry bore and entering the exit bore.

FIG. 10 is a perspective view of a portion of an exemplary ball tether assembly 28 depicting the single-strap tether 104 exiting the entry bore 100 and entering the exit bore 102 at the underside of the ball 30.

As described more fully above, FIG. 11 is a close-up view of the in-line stop feature 44 with directional arrows $A_D$ depicting the loop threading 96 of the rope line 24 about the stopping mass 94 to permit the height-adjustable, in-line stop feature 44 to be adjustably handled so the stopping mass 94 may be moved and secured along the incline line 26.

As depicted in FIGS. 12 and 13, perspective close-up views of the in-line shock-absorbing impact-recoil feature 42 are shown pre-impact (FIG. 12) where the impact-receiving mass 54 rests against the lower stop 50 positioned for impact and post-impact (FIG. 13) showing impact-caused movement of the impact-receiving mass 54 in phantom lines.

Figure 14:
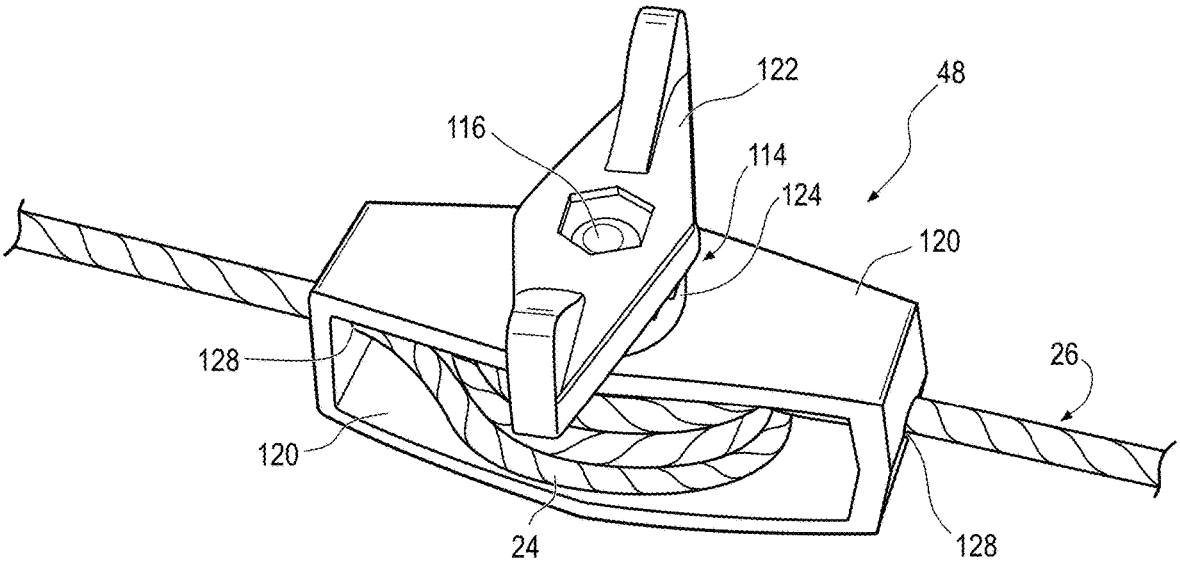
FIG. 14 is a perspective close-up view of another portion of the inclined line depicting an in-line line tensioner showing the incline line drawn taut and secured at that tension.
Figure 15:
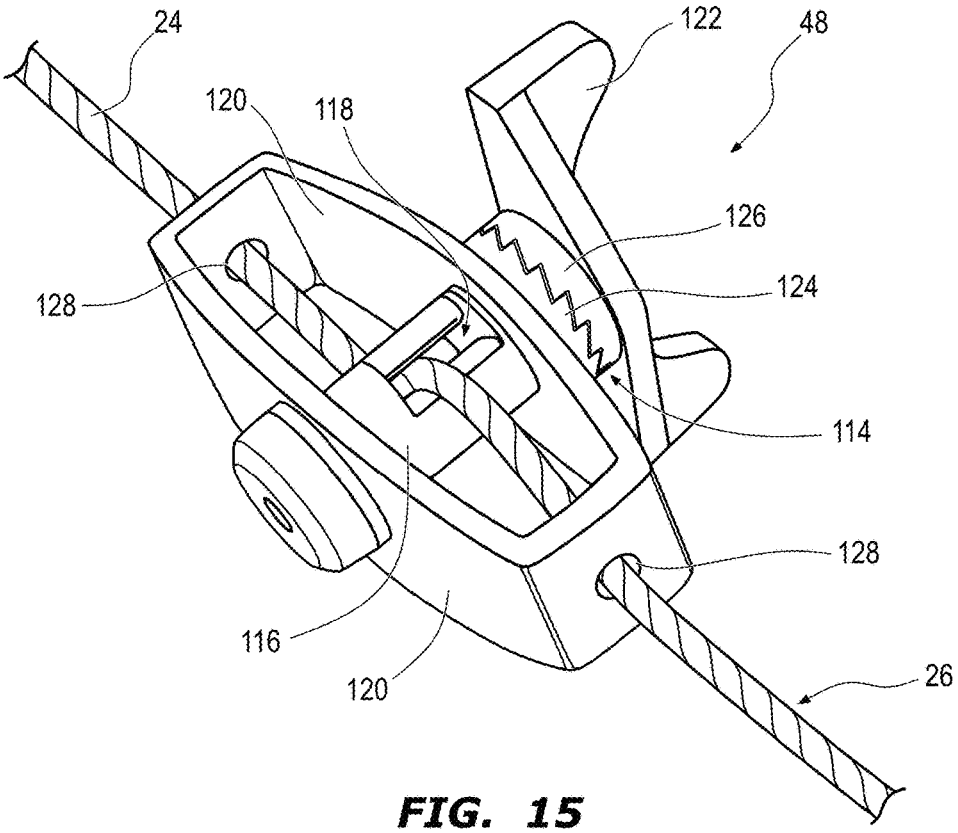
FIG. 15 is a perspective close-up view of the portion of the inclined line shown in FIG. 14 depicting the in-line line tensioner prior to drawing the incline line taut wherein the tension is slack.

FIGS. 14 and 15 are differing perspective close-up views of an exemplary in-line tensioner 48. FIG. 14 depicts the in-line tensioner 48 showing the incline line 26 drawn taut and secured at that tension. FIG. 15 depicts the in-line line tensioner 48 threaded and just prior to drawing the incline line 26 taut wherein the tension is slack. As discussed above, keeping the inclined line 26 under proper tension over time, without requiring the rope line 24 disconnection and reconnection, is desirable. Furthermore, after training session usage of the ball-hitting trainer 10, depending on the composition of the rope line 24, proper maintenance of the rope line 24 may require the tension on the rope line 24 to be loosened between training sessions.

The exemplary in-line tensioner 48 embodiment shown in FIGS. 14 and 15 comprises an engaging/disengaging ratchet mechanism 114, for example a fence line tensioner having an axle 116 with a slot 118 rotatably held within a frame 120, wherein the axle 116 has a crank handle 122 attached and a ratchet gear 124 and pawl 126 allow the axle 116 to be rotated one direction and after releasing the pawl 126, the axle 116 may rotate the opposite direction. The frame 120 has through holes 128 so that the rope line 24 may pass through one of the through holes 128, then through the slot 118, and then through another through hole 128. With this configuration, the turning of the crank handle 122 in the direction permitted by the ratchet gear 124 and pawl 126 will wind the rope line 24 around the axle 116, tightening the rope line 24. To loosen the rope line 24 the pawl 126 is released from locking engagement with the ratchet gear 124 so that the axle 116 may reverse its rotation to loosen the rope line 24.

Of course, other forms of in-line tensioners 48 are known and may be used. However, the in-line tensioner 48 depicted is lightweight (constructed of plastic, or lightweight metal, or any other suitable material), simple to operate, and inexpensive. To accommodate more robust training, more robust materials may be used with the depicted in-line tensioner 48 or a more heavy-duty in-line tensioner 48 may be used. Those skilled in the art will know what in-line tensioners 48 will work best with ball-hitting trainers 10 requiring heavy use or accommodating differing skill levels or differing training regimens.

Those skilled in the art will appreciate that the present embodiments are exemplary and representative and should not be limited to the embodiments shown and described.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A ball-hitting trainer for teaching hitting/striking skills and establishing muscle-memory for a user, the ball-hitting trainer being mountable on a support surface and comprising:

a plurality of stanchions disposed upright and comprising a first stanchion and a second stanchion, each stanchion having an apex and a base, the base of the first stanchion being spaced a run distance from the second stanchion;

a rope line being connected between the first stanchion and the second stanchion, the rope line spanning a distance from a first connection to the first stanchion to a second connection to the second stanchion, the second connection being disposed at a greater height from the support surface than the height of the first connection from the support surface thereby forming an inclined line having an upper portion and a lower portion;

a ball tether assembly disposed about the rope line in sliding engagement with the rope line, thereby enabling the ball tether assembly to travel along the rope line in a travel path when hit or struck by the user and to return to the user; and an in-line shock-absorbing impact-recoil feature positioned within the upper portion of the inclined line and for absorbing impact force of the ball tether assembly on the in-line shock-absorbing impact-recoil feature, thereby minimizing the impact force on the second stanchion and thereby imparting recoil force to the ball tether assembly returning the ball tether assembly downward along the rope line toward the lower portion of the inclined line, wherein the in-line shock-absorbing impact-recoil feature comprises a lower stop, an upper stop spaced from the lower stop, and an impact-receiving mass slidably engaging the inclined line and movable between the lower stop and the upper stop and the impact-receiving mass is a ball having a central bore having a diameter greater than the diameter of the inclined line and less than the lower stop and upper stop, and the ball tether assembly having a suspension ring having an inner diameter greater than the lower stop.

2. The ball-hitting trainer of claim 1 further comprising an in-line stop feature positioned within the lower portion of the inclined line and for stopping downward movement of the ball tether assembly and allowing the ball tether assembly to rest suspended from the inclined line and against the in-line stop feature.

3. The ball-hitting trainer of claim 2 wherein the in-line stop feature is adjustable along the inclined line to determine the height above the support surface at which the ball tether assembly is suspended.

4. The ball-hitting trainer of claim 3 wherein the in-line stop feature comprises a stopping mass having a central conduit through which the rope line is looped around the stopping mass and through the central conduit such that when the rope line is looped around the stopping mass is loose, the stopping mass may advance upward or downward along the inclined line to a desired position, and the stopping mass is secured in the desired position by drawing the rope line taut thereby also drawing taut the rope line looped around the stopping mass.

5. The ball-hitting trainer of claim 1 wherein at least one of the stanchions is height adjustable.

6. The ball-hitting trainer of claim 5 wherein the at least one stanchion that is height adjustable comprises telescoping pole segments.

7. The ball-hitting trainer of claim 5 wherein the at least one stanchion that is height adjustable comprises pole segments of distinct lengths.

8. The ball-hitting trainer of claim 1 wherein at least one of the stanchions has an anchoring feature that comprises at least part of the connection of the rope line to the at least one stanchion.

9. The ball-hitting trainer of claim 8 wherein the at least one anchoring feature is selected from a group connectors consisting of moorings, mooring cleats, rope cleats, clips, eyelets, dual eyelets, hooks, dual hooks, snap hooks, clamps, anchor rings, carabiners, and cable fasteners.

10. The ball-hitting trainer of claim 8 further comprising at least one guy line secured at one end to one of said at least one anchoring feature and secured at an opposite end to the support surface.

11. The ball-hitting trainer of claim 1 wherein the ball tether assembly comprises a ball, a suspension ring, and a tether secured between the ball and the suspension ring.

12. The ball-hitting trainer of claim 1 further comprising an in-line tensioner for tightening and loosening the rope line.

13. The ball-hitting trainer of claim 12 wherein the in-line tensioner has an engaging/disengaging ratchet mechanism.

14. A ball-hitting trainer for teaching hitting/striking skills and establishing muscle-memory for a user, the ball-hitting trainer being mountable on a support surface and comprising:

a plurality of stanchions disposed upright and comprising a first stanchion and a second stanchion, each stanchion having an apex and a base, the base of the first stanchion being spaced a run distance from the second stanchion;

a rope line being connected between the first stanchion and the second stanchion, the rope line spanning a distance from a first connection to the first stanchion to a second connection to the second stanchion, the second connection being disposed at a greater height from the support surface than the height of the first connection from the support surface thereby forming an inclined line having an upper portion and a lower portion;

a ball tether assembly disposed about the rope line in sliding engagement with the rope line, thereby enabling the ball tether assembly to travel along the rope line in a travel path when hit or struck by the user and to return to the user, the ball tether assembly comprising a ball, a suspension ring, and a tether secured between the ball and the suspension ring;

an in-line shock-absorbing impact-recoil feature positioned within the upper portion of the inclined line and for absorbing impact force of the ball tether assembly on the in-line shock-absorbing impact-recoil feature, thereby minimizing the impact force on the second stanchion and thereby imparting recoil force to the ball tether assembly returning the ball tether assembly downward along the rope line toward the lower portion of the inclined line; and an in-line stop feature positioned within the lower portion of the inclined line and for stopping downward movement of the ball tether assembly and allowing the ball tether assembly to rest suspended from the inclined line and against the in-line stop feature, wherein the in-line stop feature is adjustable along the inclined line to determine the height above the support surface at which the ball tether assembly is suspended, the in-line stop feature comprises a stopping mass having a central conduit through which the rope line is looped around the stopping mass and through the central conduit such that when the rope line is looped around the stopping mass is loose, the stopping mass may advance upward or downward along the inclined line to a desired position, and the stopping mass is secured in the desired position by drawing the rope line taut thereby also drawing taut the rope line looped around the stopping mass.

15. The ball-hitting trainer of claim 14 wherein the second stanchion is height adjustable to adjust the angle of incline of the inclined line.

16. The ball-hitting trainer of claim 14 wherein the ball of the ball tether assembly is selected from a group of balls consisting of a baseball, a softball, a tennis ball, a golf ball, a soccer ball, a cricket ball, a foam ball, a pickleball, a wiffle ball, a handball, a racquetball ball, a field hockey ball, a street hockey ball, a lacrosse ball, a volleyball, a kickball ball, and a squash ball.

17. A ball tether assembly slidably connectable to an inclined line connected between a lower-height anchoring feature and a higher-height anchoring feature for enabling travel of the ball tether assembly adjacently along the inclined line upward and downward in response to a force being exerted upon the ball tether assembly, the ball tether assembly comprising:

a ball, a suspension ring;

a single-strap tether secured between the ball and the suspension ring, the single-strap tether comprising a strap having a length, a breadth, and a thickness, the length of the strap being the distance from a first end and a second end;

wherein the suspension ring encircles the inclined line such that the ball is suspended a working distance from the inclined line; and wherein the ball has two through bores lying in a first plane that substantially halves the ball and each of the two through bores, one an entry through bore and the other an exit bore, being positioned substantially equidistant from a second plane that substantially halves the ball and is substantially perpendicular to the first plane, and wherein the first end of the single-strap tether enters and passes through the entry through bore and then enters and passes through the exit through bore creating a first extent extending from the exit through bore and a second extent of the single-strap tether extending from the entry through bore, a portion of the first extent passes through the suspension ring such that the first end approaches the ball, the second extent passes through the suspension ring overlapping against and capturing a portion of the first extent between a corresponding portion of the second extent, the second extent being secured in overlapping engagement to the first extent proximate the suspension ring and proximate the first end and the second end of the strap thereby reinforcing the single-strap tether.

* * * * *